United States Patent [19]

Barkan

[11] 4,099,039

[45] Jul. 4, 1978

[54] MEANS FOR EFFECTIVELY CONTROLLING THE FORCES IMPOSED ON THE MOVABLE CONTACT OF A VACUUM-TYPE CIRCUIT INTERRUPTER

[75] Inventor: Philip Barkan, Media, Pa.

[73] Assignee: General Electric Company, Philadelphia, Pa.

[21] Appl. No.: 752,956

[22] Filed: Dec. 20, 1976

[51] Int. Cl.[2] ..... H01H 33/66

[52] U.S. Cl. ..... 200/144 B; 200/288

[58] Field of Search ..... 200/144 B, 288; 335/195, 16

[56] References Cited

U.S. PATENT DOCUMENTS

| | | | |
|---|---|---|---|
| 3,180,960 | 4/1965 | Barkan et al. | 200/288 |
| 3,366,900 | 1/1968 | Barkan | 200/144 B |
| 3,527,911 | 9/1970 | Sharp | 200/144 B |
| 3,663,906 | 5/1972 | Barkan et al. | 335/195 |

*Primary Examiner*—Robert S. Macon

*Attorney, Agent, or Firm*—William Freedman; Carl L. Silverman

[57] ABSTRACT

This vacuum-type circuit breaker has means for substantially reducing the tendency of the contacts to bounce apart in response to the impact between the contacts occurring at the end of a closing stroke. The circuit breaker includes a contact-wipe mechanism comprising a driving part and a wipe spring located between the driving part and the movable contact which spring is loaded to produce added closing force on the movable contact by continuing closing motion of the driving part after the contacts initially engage at the end of the closing stroke. The wipe mechanism further includes a bounce-suppressing spring acting in opposition to the wipe spring and discharging to aid said continuing closing motion of said driving part during the initial stages of said continuing motion following initial contact-engagement.

The wipe mechanism also includes means for precisely controlling the forces imposed on the movable contact by acceleration at the start and termination of a contact-opening stroke.

24 Claims, 11 Drawing Figures

MEANS FOR EFFECTIVELY CONTROLLING THE FORCES IMPOSED ON THE MOVABLE CONTACT OF A VACUUM-TYPE CIRCUIT INTERRUPTER

BAGKGROUND

This invention relates to means for substantially reducing the tendency of the contacts of a vacuum-type circuit interrupter to bounce apart in response to the impact between the contacts occurring at the end of a closing stroke of the movable contact. The invention also relates to means for precisely controlling the forces imposed on the movable contact by acceleration at the start and the termination of a contact-opening stroke.

A vacuum-type circuit interrupter typically comprises an evacuated housing, a stationary and a movable contact within the housing, and stationary and movable contact rods respectively supporting the contacts and extending between the interior and exterior of the housing in sealed relationship to the housing. It is advantageous to support such an interrupter in a vacuum circuit breaker by providing a substantially rigid support for the stationary contact rod. When the interrupter is so supported, impact forces developed when the movable contact strikes the stationary contact at the end of a closing stroke are transmitted directly to said support, effectively bypassing the housing. This bypassing is desirable in that it greatly reduces the mechanical loads that are imposed by such impact forces on the brittle glass or ceramic of the housing and on any glass-to-metal seals and welded or brazed joints in the housing.

I have found that when the interrupter is supported as in the immediately-preceding paragraph (instead of being supported from its opposite, or movable-contact, end) there is a much greater tendency for the contacts to bounce apart in response to the closing impact. Such bouncing is undesirable because it results in inter-contact arcing during the bounce period, which leads to undue contact-erosion and contact-welding. In studying this problem in a high-current circuit breaker having a conventional actuating mechanism (which comprises a contact-driving linkage coupled to the movable contact through a conventional wipe mechanism), I have found that the rigid mounting of the stationary contact results in opposing force on the actuating mechanism building up at an extremely rapid rate when the contacts impact. I have further found that the inherent flexibility of the linkage allows this abruptly-developed opposing force, surprisingly, to temporarily reverse the motion of the output end of the actuating mechanism, thereby temporarily pulling open the movable contact. Shortly thereafter, when the linkage has deformed sufficiently to allow for a build-up of the required closing force to overcome this opposition, such closing force acts to drive the movable contact back into engagement with the stationary contact to complete the closing operation. The above-described stalling of the actuating mechanism accompanied by subsequent contact separation can occur, I have found, despite the fact that the operating device for the actuating mechanism is making available more than enough closing energy at the input end of the actuating mechanism to overcome the opposing force.

SUMMARY

An object of my invention is to greatly reduce the above-described tendency for the movable contact to bounce away from the stationary contact at the end of a closing operation in a vacuum interrupter that is mounted in generally the above-described manner (i.e., with its stationary contact rigidly supported).

For the high current vacuum circuit breaker I am concerned with, high operating forces are required to close and hold closed the contacts when they are subjected to high fault currents, and also to open the contacts at the required high speed. With respect to opening, a certain minimum impact force must be applied to the movable contact at the time of contact-parting to assure that any welds between the contacts are immediately broken and further to maintain rapid contact-parting to minimize contact erosion. A problem presented by these high opening impact forces is that they have a tendency to produce such high accelerations that the contacts of the interrupter can be deformed thereby.

Accordingly, another object of my invention is to provide, in a high-current vacuum circuit breaker, means for limiting the impact forces developed at the start of an opening operation to a precisely controlled level sufficiently high to assure contact-parting at the required speed yet sufficiently low to prevent deformation of the contacts.

Another object is to arrest contact-opening motion at the end of the opening stroke in such a way as to prevent deformation of the contacts.

Still another object is to provide in the wipe mechanism spring means capable of functioning both at the start and the termination of the opening stroke to achieve the two immediately-preceding objects.

Still another object is to provide a wipe mechanism for a vacuum circuit breaker which includes means for accomplishing all four of the objects set forth hereinabove.

In carrying out the invention in one form, I provide the vacuum-type circuit breaker with means for substantially reducing the tendency of its contacts to bounce apart in response to the impact produced between the contacts when they first engage at the end of a closing stroke. This circuit breaker includes a contact-wipe mechanism comprising a driving part and a wipe spring located between the driving part and the movable contact which spring is loaded to produce added closing force on the movable contact by continuing closing motion of the driving part after the contacts initially engage at the end of the closing stroke. The wipe mechanism further includes a bounce-suppressing spring acting in opposition to the wipe spring and discharging to aid said continuing closing motion of said driving part during the initial stages of said continuing motion following initial contact-engagement. This discharge of the bounce-suppressing spring at this time appreciably reduces the rate at which force builds up on the contacts immediately following their initial engagement, and this reduction in the rate of force build-up reduces the tendency to produce contact-bounce. The bounce-suppressing spring has a stiffness sufficiently low to effectively prevent separation of the contacts immediately following initial contact-engagement at the end of the closing stroke.

In accordance with another feature of my invention, the contact-wipe mechanism further comprises force-transmitting means impacted by said driving part after a predetermined initial motion of said driving part in a contact-opening direction for transmitting contact opening force from said driving part to said movable contact. This force-transmitting means comprises preloaded auxiliary spring means that yields in response to said impact to reduce the initial accelerating force applied to said movable contact. Opening-motion teminating means acts near the end of an opening stroke to apply through said auxiliary spring means a decelerating force to said movable contact.

BRIEF DESCRIPTION OF THE DRAWINGS

For a better understanding of the invention, reference may be had to the accompanying drawings, wherein:

In FIG. 6 the circuit breaker is shown in its fully-closed position.

DETAILED DESCRIPTION OF PREFERRED EMBODIMENTS

EMBODIMENT OF FIGS. 1-5

Figure 1:
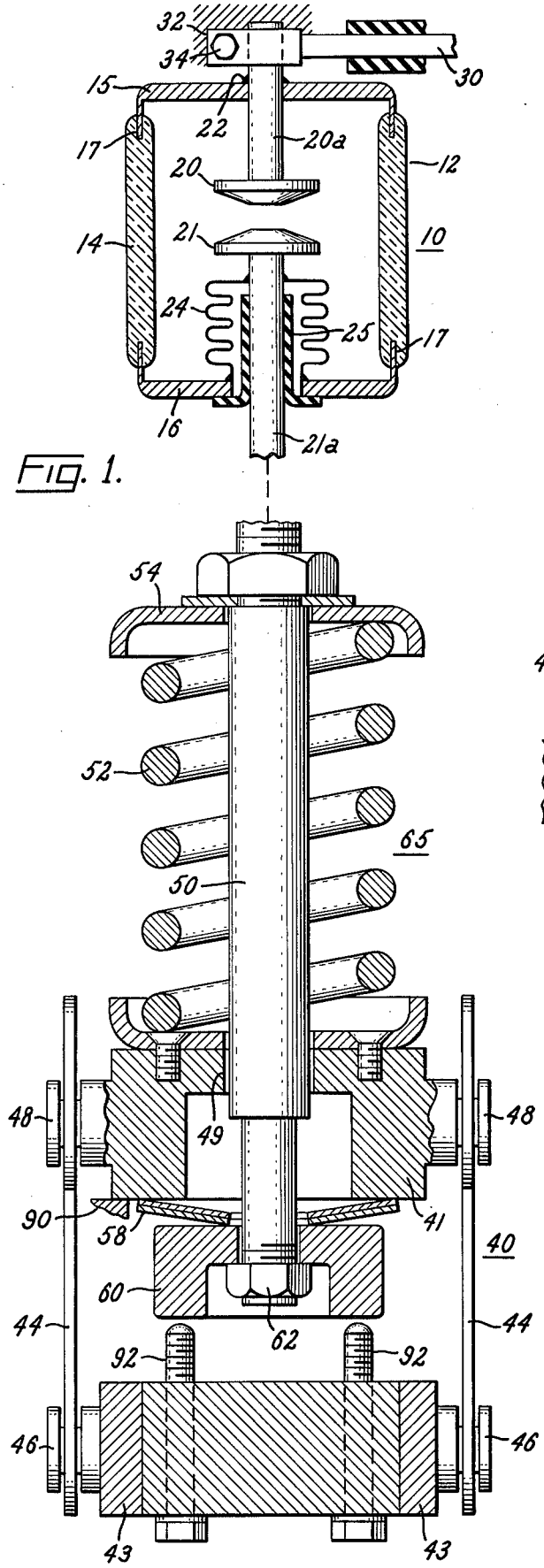
FIG. 1 is a sectional view, partly schematic, showing a vacuum circuit breaker embodying one form of my invention. The circuit breaker is shown in its fully-open position.

Referring now to FIG. 1, there is shown a vacuum-type circuit interrupter 10 comprising a highly evacuated housing 12. This housing 12 comprises a tubular casing 14 of insulating material such as glass and two end caps 15 and 16 at opposite ends of the casing joined to the casing by suitable vacuum-tight glass-to-metal seals 17. Located within the evacuated housing 12 are two engageable, relatively-movable contacts 20 and 21. Contact 20 is a stationary contact fixed to the inner end of a conductive stationary contact rod 20*a*, and contact 21 is a movable contact fixed to the inner end of a movable conductive contact rod 21*a*.

The two contact rods 20*a* and 21*a* extend between the interior and exterior of the evacuated housing 12 through openings in the end caps 15 and 16, respectively. A vacuum-tight welded joint 22 secures stationary contact rod 20*a* to end cap 15. A flexible metal bellows 24 of conventional form surrounds movable contact rod 21*a* and provides a flexible vacuum-tight joint therearound that allows contact rod 21*a* to be moved vertically without impairing the vacuum inside envelope 12. A tubular guide 25 suitably fixed to the lower end cap guides the movable contact rod 21*a* along a substantially straight-line vertical path.

For supporting the interrupter, I provide a substantially rigid stationary support 30. In the illustrated embodiment, this support 30 has a split end 32 forming two arms which are tightly clamped about the stationary contact rod 20*a* by means of a clamping bolt 34. In one form of the invention, these parts 30, 32 are of conductive material and serve as part of the power circuit that extends through the interrupter.

Figure 2:
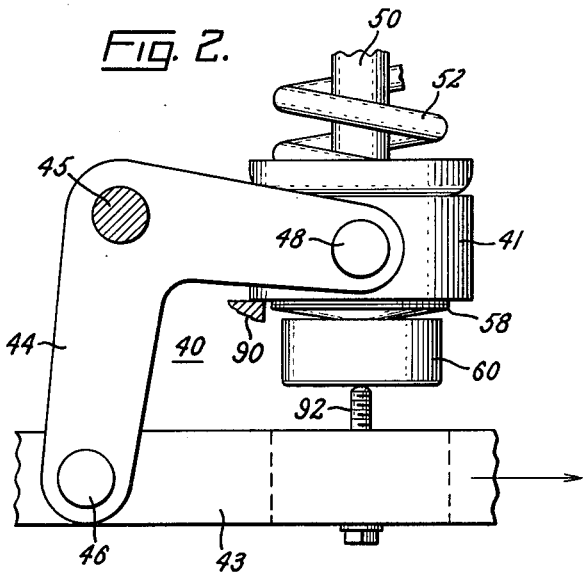
FIG. 2 is a side elevational view of a portion of the structure of FIG. 1.

For actuating movable contact 21, I provide an operating linkage 40 that comprises a trunnion 41 that is upwardly movable in a vertical direction from its position of FIG. 1 to close the interrupter. As shown in FIGS. 1 and 2, trunnion 41 is coupled to a horizontally-movable link 43 through two identical, interconnected bell-cranks 44 that are pivoted on a stationary pivot 45. One arm of each bell-crank is pivotally connected to horizontally-movable link 43 by a pivot 46, and the other arm is pivotally connected to the trunnion 41 by a pivot 48. The link 43 is adapted to be driven in a horizontal closing direction by a suitable operating device, such as shown and claimed, for example, in my application Ser. No. 703,328, filed July 8, 1976, and assigned to the assignee of the present invention. That closing device, which is designated 10 in the aforesaid application, comprises a flywheel 30 driven by a spring 40 closely coupled to the flywheel. The flywheel 30 is mechanically connected through suitable force-transmitting means (not shown in the present application) to the link 43 of the present application. Those parts of the drive train that are connected between flywheel 30 and the trunnion 41 of the present application may be thought of as the operating linkage 40. The operating linkage also includes an opening spring biasing the linkage in a direction to open the contacts.

Trunnion 41 has a central hole 49 that slidably receives an operating rod 50 that is positively coupled to movable contact rod 21*a*. For transmitting closing force from trunnion 41 to operating rod 50, a compression-type wipe spring 52 is provided. This wipe spring bears at its lower end against trunnion 41 and at its upper end against a shoulder 54 effectively fixed to operating rod 50. Compression spring 52 is preloaded so that it exerts a predetermined upward force on operating rod 50 when the parts are in the position of FIG. 1.

Opposing the upwardly-acting force of wipe spring 52 on operating rod 50 is a disc spring 58 which exerts a downward force on the operating rod 50. This disc spring comprises one or more annular washers normally of a generally conical shape located between the lower face of trunnion 41 and a stop 60 on the lower end of operating rod 50. Stop 60 is free to slide on the operating rod but is normally held by spring force against a nut 62 fixed to the lower end of the operating rod, as shown in FIG. 1. The wipe spring 52 is substantially stronger than the disc spring 58 and thus deflects the normally-conical disc spring into the almost flat configuration of FIG. 1 when the parts are in their position of FIG. 1. The following parts may be thought of as constituting a wipe mechanism 65 for coupling the aforesaid operating linkage 40 to the upper end of operating rod 50: trunnion 41, wipe spring 52, disc spring 58, parts 54, 60, and 62, and the lower end of operating rod 50. The series combination of the wipe mechanism 65 and the aforesaid operating linkage 40 connected thereto may be thought of as an "actuating mechanism" for the movable contact.

Figure 3:
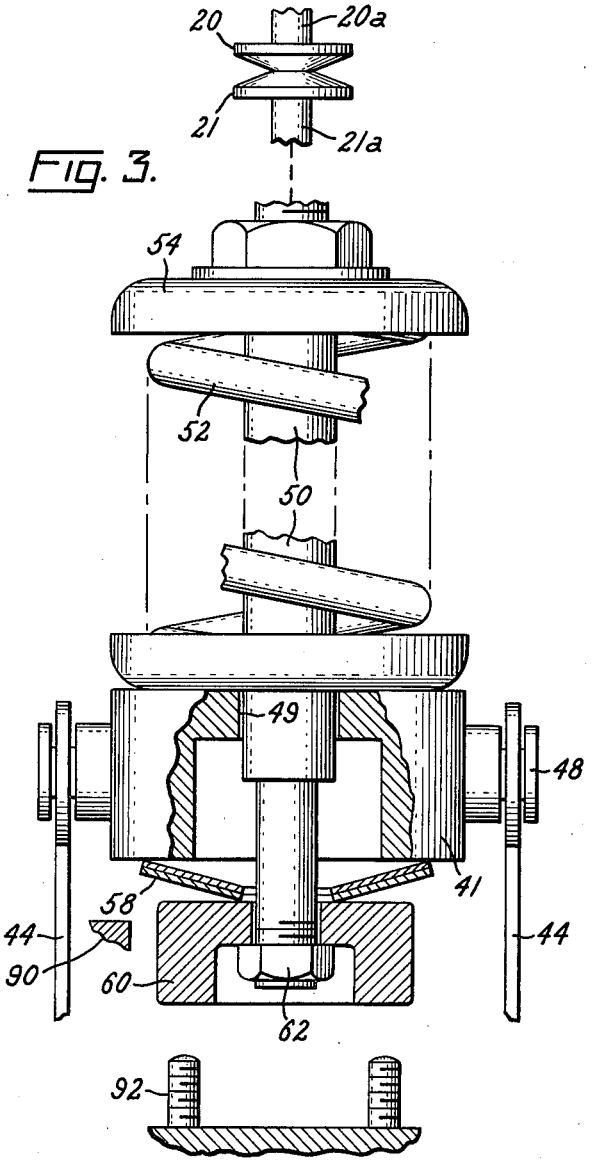
FIG. 3 illustrates the circuit breaker of FIG. 1 immediately after its contacts have engaged near the end of a closing operation.

When trunnion 41 is driven upwardly during a closing operation, it transmits closing force through the wipe mechanism 65 to operating rod 50 without substantially deflecting the springs 52 and 58 until movable contact 21 engages stationary contact 20. The trunnion 41 continues to move upwardly following initial contact-engagement, and this compresses the wipe spring 52 while allowing the disc spring 58 to unload and return toward its normal generally conical shape. This continued upward movement of the trunnion 41 is referred to as wipe travel. FIG. 3 depicts the parts at an intermediate point in the course of such wipe travel.

Figure 4:
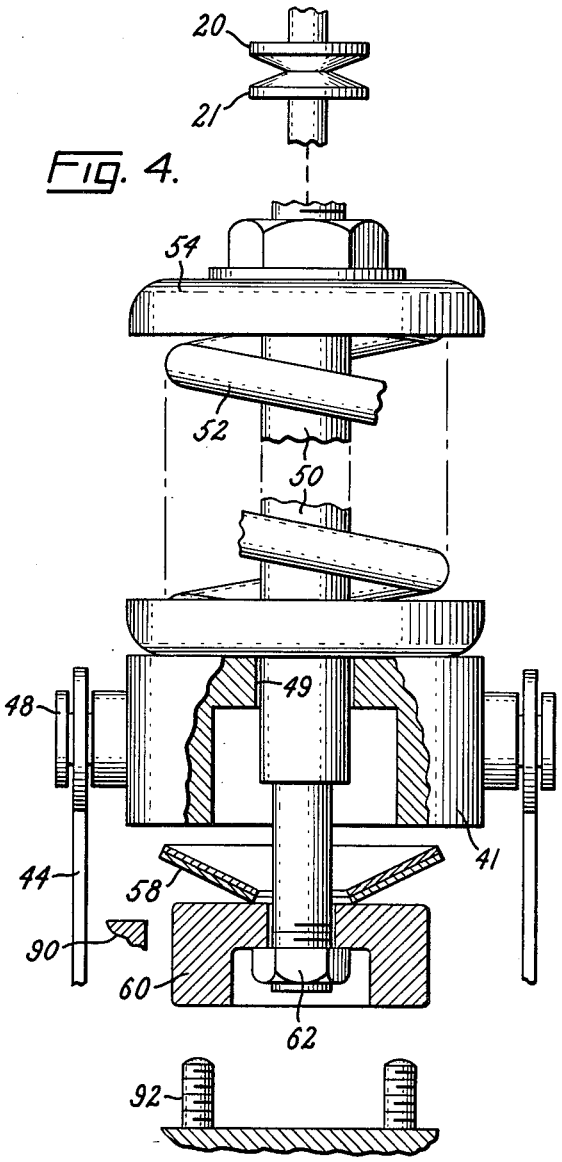
FIG. 4 illustrates the circuit breaker of FIG. 1 after the closing operation has been completed.

FIG. 4 depicts the parts after such wipe travel has been completed. It will be apparent from FIG. 4 that the additional wipe travel of the trunnion 41 past the position of FIG. 3 further compresses wipe spring 52 and completely unloads disc spring 58, opening a gap between the lower side of the trunnion and the unloaded disc spring.

In working with a circuit breaker essentially the same as shown in FIG. 1–4 except without the disc spring 58, I found that the contacts bounce apart immediately following initial contact engagement. This behavior was initially quite puzzling, particularly since the problem became worse when contact-wipe spring force was increased, which is generally not the case with other contact-bounce phenomena. In the course of my studies of this contact-bounce problem in such a circuit breaker, I found that the substantially rigid mounting of the stationary contact 20*a* of the interrupter combined with the high wipe-spring force was causing a high opposing force on the upper end of the oeprating rod to be built up at an extremely rapid rate upon contact impact. I found further that the inherent flexibility of the operating linkage 40 was allowing this abruptly developed opposing force, suprisingly, to temporarily reverse the motion of the operating rod 50, thereby temporarily pulling open the movable contact 21. A short time thereafter when the operating linkage had deformed sufficiently to build up the required closing force on the operating rod to overcome this opposition, the movable contact moved back into engagement with the stationary contact.

Figure 5:
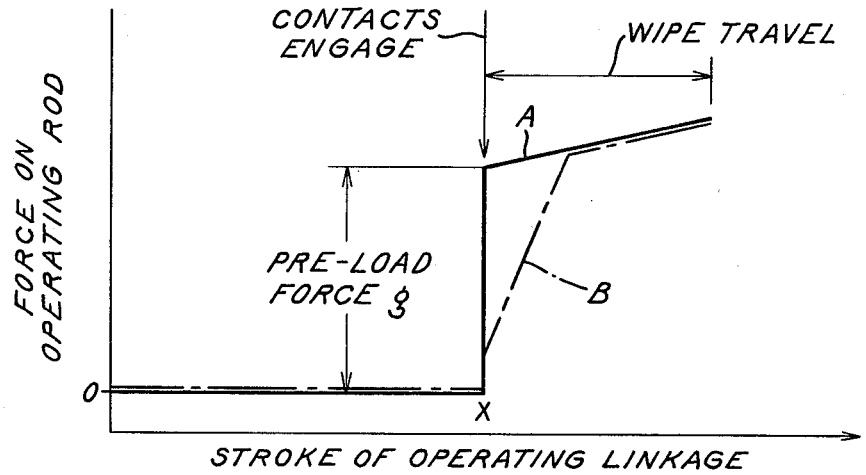
FIG. 5 is a graphic showing of force on the output end of the circuit-breaker actuating mechanism during a closing stroke. The solid line curve A represents this force with a conventional actuating mechanism, and the dotted line curve B represents this force with the actuating mechanism illustrated in FIGS. 1–4.

The manner in which this force was building up (in the breaker without disc spring 58) is depicted by curve A in FIG. 5, where the force is plotted against the stroke of the operating linkage 40. No force is present until the contacts engage. But when the contacts do engage at point X in the linkage stroke, the force builds up almost as a step function to the value of the precompression load in the wipe spring, thereafter increasing at a much lower rate as the linkage continues moving through its wipe travel.

My solution to this contact-bounce problem is based upon recognition of the need to apply the contact force relatively gradually when the contacts initially engage on closing. I have achieved this effect by providing the above-described disc spring 58 related to the trunnion 41 in the manner shown in FIGS. 1–4. This disc spring 58 unloads during wipe travel following initial contact-engagement in the manner already described. Note that the disc spring 58, being located between the trunnion and the stop 60, 62 on the operating rod 50 tends to push the operating rod 50 downward, which is in the opposite direction to the force exerted by the wipe spring 52. Thus, when the contacts engage as in FIG. 3, the force acting on the contacts and hence on the actuating mechanism 40, 65 is the difference between the force exerted by the wipe spring 52 and that exerted by the disc spring 58. The gradient of the disc spring determines the distance travelled by the operating linkage 40 (and hence the time elapsed) between intial contact-engagement and complete development of contact-spring wipe force.

With the disc spring 58 present, the closing force at the output end of the actuating mechanism 40, 65 builds up following initial contact-engagement in accordance with the dotted line curve B of FIG. 5. It will be apparent that this is a much more gradual force build-up than that represented by curve A, illustrating performance without the disc spring 58.

The precise value of the gradient of the disc spring which is adequate to prevent contact-reversal can be determined from an analysis of a simplified model of the circuit-breaker actuating mechanism 40, 65, assuming that such mechanism comprises N movable contact-operating rods connected to the operating linkage 40, each through its own wipe mechanism 65 substantially identical to the wipe mechanism 65 shown. The analysis discloses that there should be a definite relationship between the stiffness gradient K of the operating linkage 40 and the stiffness gradient k of each of the disc springs 58 in the wipe mechanism, or mechanisms, operated by the linkage. To prevent reversal of the output end of the actuating mechanism, it is necessary that the following inequality be maintained:

$$\frac{K}{Nk} \geqq \left\{ -\left[ \frac{\sin \eta t}{\eta t} \right] \right\} \text{Max.}$$

where $\eta$ is the fundamental natural frequency of the circuit breaker operating linkage 40, expressed in radius per second, and t is time, measured from the time of initial contact engagement on closing. It is readily found that the maximum positive value of the right-hand side of this relationship is 0.22. Thus, this relationship requires that $$\frac{K}{Nk} \geqq .22, \text{ or } k \leqq \frac{K}{.22N}$$

In the usual 3-phase circuit breaker, there are three interrupters and hence three wipe mechanisms, usually substantially the same, all operated by a common operating linkage (such as 40). Hence, according to the above relationship, in such a circuit breaker, $k$ should be less than about 1.5 K in order to prevent reversal of the output end of the actuating mechanism. To provide adequate margin in such a circuit breaker to insure against such reversal, it is preferred that the stiffness gradient $k$ of the disc springs be about equal to the stiffness gradient K of the operating linkage.

Tests made with this actuating mechanism 40, 65 have confirmed that where the gradients $k$ and K are substantially equal, such reversal of the operating rod 50 will be prevented, and performance free of bounce from this source will be obtained.

Stated in general terms, the bounce-suppressing spring 58 should have a stiffness gradient sufficiently low to essentially prevent separation of the contacts immediately following initial contact-engagement at the end of the closing stroke.

Although the actuating mechanism 40, 65 of FIGS. 1–4 is especially well suited for utilization in a circuit breaker in which the generally stationary contact 20 is substantially rigidly mounted on a stationary support, the mechanism can also be used advantageously to prevent the contacts from bouncing apart following initial engagement where there is some slight yieldability or resilience in the mounting for contact 20. In this respect, generally speaking, introduction of the bounce-suppressing spring 58 produces effective contact-bounce suppression (by preventing the above-described contact separation) in those circuit breakers where the opposing forces exerted on the operating linkage upon contact-engagement increase rapidly (i.e., from zero to the wipe-spring preload force g as seen in FIG. 5) in a time $t_1$ which is substantially shorter than one-fourth of the natural period $T_2$ of vibration of the operating linkage.

Opening of the circuit breaker of FIGS. 1–4 is effected by driving the trunnion 41 downwardly from its position of FIG. 4. This downward motion substantially flattens the disc spring 58 and thereafter applies downward opening force to the operating rod 50.

Figure 6:
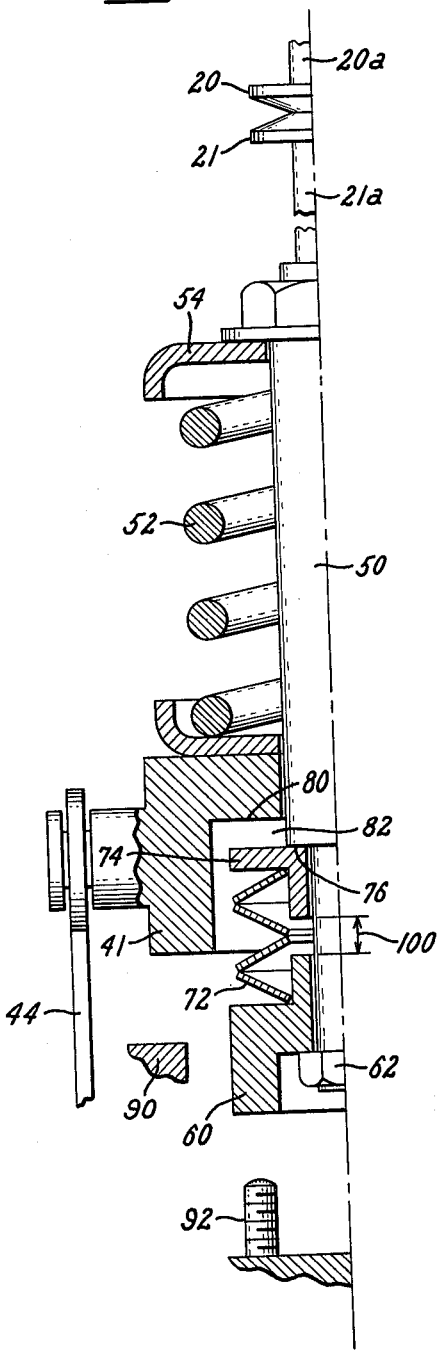
FIG. 6 is a sectional view of a vacuum circuit breaker embodying a modified form of my invention.
Figure 7:
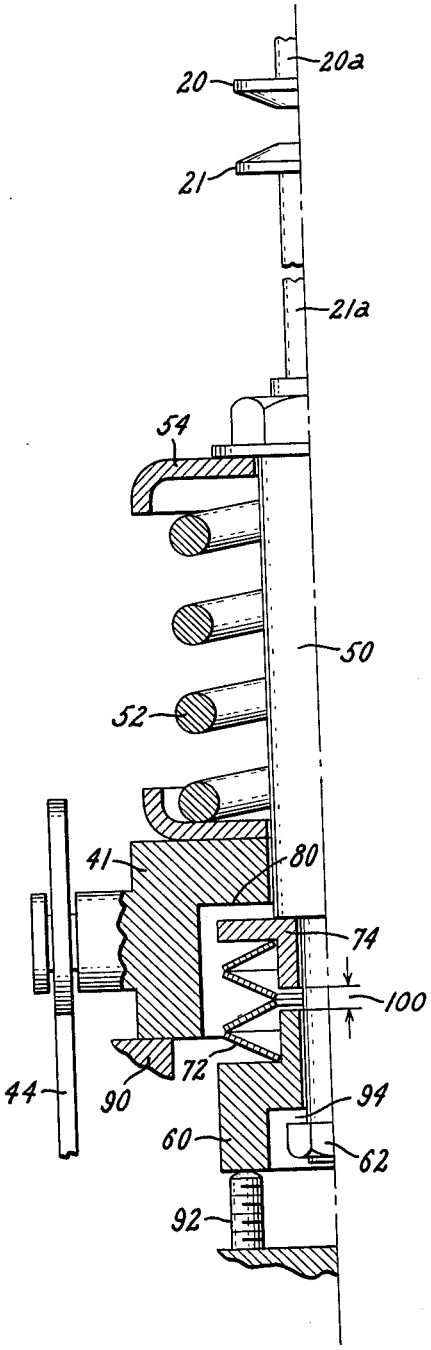
FIG. 7 shows the circuit breaker of FIG. 6 at the end of a circuit-breaker opening stroke but while the contact rod 50 is undergoing limited overtravel.

EMBODIMENT OF FIGS. 6 and 7

Starting an Opening Operation

Another object of my invention set forth hereinabove is to limit the impact forces developed at the start of an opening operation to a precisely-controlled level sufficiently high to ensure contact-parting at the required speed, yet sufficiently low to prevent deformation of the contacts.

FIG. 6 and 7 illustrate an arrangement for achieving this objective. The parts thereof that correspond to similar parts in FIGS. 1–4 have been assigned the same reference numerals as in FIGS. 1–4. In FIG. 6 the circuit breaker is shown in its fully-closed position.

The circuit breaker of FIGS. 6 and 7 does not have the disc spring 58 of FIG. 1, but it does have an auxiliary spring 72 disposed between a sleeve 74 and the stop 60. Sleeve 74 is slidably mounted on operating rod 50. Auxiliary spring 72 comprises a stack of annular conical disc springs. Auxiliary spring 72 is preloaded to a substantially greater force than the wipe spring 52. The preload in the auxiliary spring is adjusted by suitably adjusting the nut 62 on the lower end of operating rod 50 to the appropriate position. The auxiliary spring 72 biases sleeve 74 upwardly into engagement with a shoulder 76 on operating rod 50. When the circuit breaker is in its closed position of FIG. 6, the lower face 80 of trunnion 41 is spaced upwardly from sleeve 74 by a gap 82, which represents wipe travel.

It should be noted that the auxiliary spring 72 in FIG. 6 is compressed between the shoulder 76 and the nut 62, both on the operating rod 50. There is in this state no net force developed by the auxiliary spring 72 on the operating rod.

Circuit-breaker opening is effected by driving trunnion 41 rapidly downwardly. Initial downward movement takes place with little opposition, allowing the trunnion 41 to accelerate to a relatively high speed under the action principally of forces exerted by wipe spring 52, whereupon its lower face 80 strikes the sleeve 74 and drives the sleeve downwardly. This downward motion of sleeve 74 is transmitted through spring 72 to stop 60 and nut 62 on the operating rod, thus driving the operating rod downwardly through an opening stroke.

In the usual wipe spring arrangement, a shoulder or other part corresponding to sleeve 74 is rigidly fixed to the operating rod 50. As a result, when a driving part corresponding to the trunnion 41 strikes the shoulder, it imposes a very high impact force on the shoulder and the operating rod. This high force rapidly accelerates the movable contact in a downward opening direction; and in a rigidly coupled high-current circuit breaker the resulting acceleration can be so severe that it sometimes deforms the movable contact.

I can precisely control this force by making the sleeve 74 slidable on rod 50, by appropriately choosing the auxiliary spring 72, and by preloading the spring by adjusting nut 62 so that the spring develops a force on sleeve 74 that is low enough to assure against damage to the movable contact as a result of opening impact. When the initially-motionless contact structure is subjected to an impact from trunnion 41, the impact is transmitted only through the auxiliary spring 72. Regardless of the speed of the impact or the rigidity and mass of the impacting member, the maximum force which is transmitted to the contact structure is strictly limited to the magnitude of the compression force provided by the auxiliary spring 72.

It is to be understood that the compression force is made high enough to assure that a minimum accelerating or impact force is always transmitted in order to assure weld-breaking between the contacts and to maintain rapid contact-parting to minimize contact erosion.

I am aware that prior to my present invention, attempts have been made to limit the impact force transmitted to the movable contact at the start of the opening operation by providing a rubber washer on a part such as the stop 60 in FIG. 4 that is impacted by the driving part (such as the trunnion 41 of FIG. 4). (In this prior circuit breaker there was no disc spring such as 58 of FIG. 4). Such a rubber washer can in fact limit these opening impact forces to levels sufficient to prevent damage to the movable contact, but it cannot aid in arresting contact-opening motion at the end of the opening stroke in the manner which my auxiliary spring 72 does, as will be explained in the next section of this specification. Moreover, it is to be noted that this rubber washer could not function in my circuit breaker in the same manner as the disc spring 58 of FIGS. 1-4 to prevent contact-separation immediately following contact-engagement at the end of a closing stroke because it is much too stiff to do so. A rubber washer (or any other type of spring) which has the properties needed for the transmitting opening impact forces in the desired manner described above will be too stiff to effectively prevent contact-separation immediately following contact-engagement on closing in a circuit breaker having an actuating mechanism comparable to my mechanism. This is a basic reason why I provide an auxiliary spring 72 for opening impact purposes that is separate from and much more heavily loaded than the bounce-suppressing spring 58. This is especially apparent in the embodiment of FIGS. 8–11, where both springs are present, as will soon be explained.

Terminating Opening Motion

As shown in FIG. 7, near the end of the downward opening stroke, the trunnion 41 strikes stationary opening stop 90, and its downward motion is thereby abruptly arrested. The operating rod 50, however, continues moving downwardly through inertia against the opposition of wipe spring 52. This continued downward motion carries the stop 60 into engagement with another generally stationary stop 92, thereby terminating downward motion of stop 60. But the operating rod 50 continues moving downwardly through inertia, further compressing wipe spring 52. This latter motion is quickly arrested, however, because it also compresses the relatively strong auxiliary spring 72 (between the downwardly-moving sleeve 74 and then-stationary stop 60). The combination of the wipe spring force and the auxiliary spring force exerts an effective decelerating force on sleeve 74 and hence on operating rod 50. At the end of downward motion of operating rod 50, a short gap has developed at 94 between nut 62 and stop 60, representing the overtravel of the operating rod with respect to stop 60. To assure an absolute limit to the overtravel the gap 100 between parts 74 and 60 is deliberately set to a prescribed limit. Part 74 will strike part 60 if operating rod 50 continues overtraveling from its position of FIG. 7 to reduce the gap 100 to zero.

Briefly summarizing this termination of opening motion, the decelerating force applied to the operating rod 50 immediately following the trunnion's 41 engaging the stop 90, as above described, is limited to that provided by wipe spring 52. This low force is inadequate to arrest contact-opening motion of the operating rod. To limit the contact-opening motion to a prescribed overtravel, the above-described second overtravel stop 92 is provided to impact the stop 60. The auxiliary spring 72 assures that tolerable deceleration forces result from impact of the stop 60 with stop 92. It should be noted that the total decelerating force following engagement of stops 60 and 92 is the sum of the force from the auxiliary spring 72 and that from the wipe spring 52. With the above-described arrangement, overtravel at the end of the opening stroke is held to a tolerable level compatible with bellows restrictions, and decelerating forces are still limited to levels compatible with contact-stress restrictions.

It should be further noted that the auxiliary spring 72 serves a multiple function. It limits the magnitude of the accelerating forces transmitted to the movable contact at the start of the opening operation and it also limits the decelerating force applied to the movable contact when this opening motion is terminated at the end of the opening stroke.

In a preferred form of the invention, stop 92 is carried by link 43 as shown in FIG. 1. But since this stop 92 is stationary when considered in the direction of motion of cooperating stop element 60 (i.e., vertically) stop 92 is referred to as being "generally stationary."

Closing of the circuit breaker of FIGS. 6 and 7 is effected by driving trunnion 41 upwardly from its position of FIG. 7 to its position of FIG. 6. After the contacts have engaged near the end of the closing stroke, trunnion 41 continues moving through wipe travel into its position of FIG. 6, compressing wipe spring 52 in the usual manner. It should be noted that during such closing motion, the auxiliary spring 72 remains captured between shoulder 76 and stop 60 and therefore does not effectively enter into the closing operation.

It is to be understood that the impact-limiting arrangement of FIGS. 6 and 7 is applicable not only to an interrupter that has its stationary contact rod rigidly mounted on a stationary support (as in FIGS. 1–4) but also to an interrupter in which the interrupter is mounted, or supported, at its opposite end (i.e., its movable-contact end).

In one embodiment of my invention, a hook (not shown) is provided to block the trunnion 41 from rebounding in a closing direction after it strikes stop 90 near the end of an opening operation. After downward overtravel of operating rod 50 past the position of FIG. 7 is terminated, operating rod 50 rebounds upwardly to carry sleeve 74 into engagement with the lower face 80 of the trunnion 41. The auxiliary spring yields in response to such engagement to reduce the impact load produced by such engagement, thus serving another desirable function.

EMBODIMENT OF FIGS. 8–11

In FIGS. 8–11, there is illustrated a modified circuit breaker having a compact wipe mechanism 65 that incorporates both the bounce-suppressing means of FIGS. 1–4 and the impact force-controlling means of FIGS. 6 and 7. In the arrangement of FIGS. 8–11, the same reference numerals have been used as in the other embodiments to designate corresponding parts. The auxiliary spring 72 in FIGS. 8–11 is positioned between a sleeve 74 and a stop 60 on the operating rod 50 and serves essentially the same function as it serves in FIGS. 6 and 7. The disc spring 58 of FIGS. 8–11 is positioned between sleeve 74 and trunnion 41 instead of between stop 60 and trunnion 41, as in FIGS. 1–4, but it serves essentially the same function as the disc spring 58 in FIGS. 1–4.

In the embodiment of FIGS. 8–11, when the breaker is in its at-rest open position, of the three springs 72, 52, and 58 that are present, the auxiliary spring 72 is loaded to the greatest force, wipe spring 52 is the next heaviest loaded, and disc spring 58 is the least loaded. Otherwise stated, auxiliary spring 72 is the strongest; wipe spring 52 is the next strongest; and disc spring 58 is the weakest.

Figure 8:
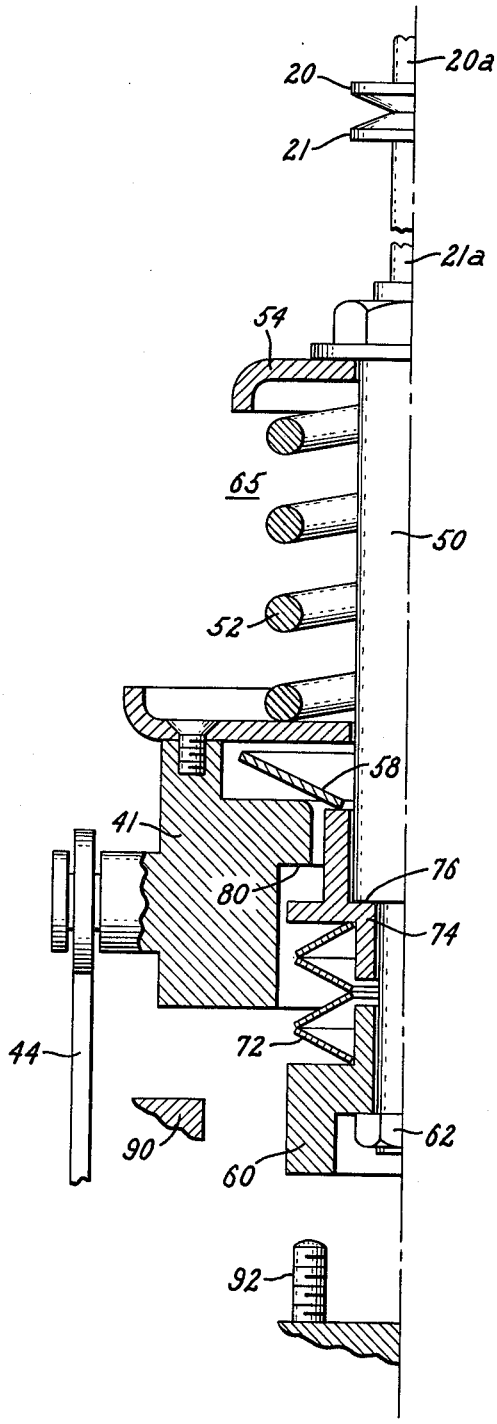
FIG. 8 shows a vacuum circuit breaker embodying another modified form of my invention. In this figure, the circuit breaker is shown in its fully-closed position.

In FIG. 8 the circuit breaker is shown in its fully-closed position. Opening is effected by driving trunnion 41 downwardly through its successive positions of FIGS. 9 and 10 into its final position of FIG. 11. Downward motion of trunnion 41 is terminated when the trunnion encounters stop 90, as shown in FIG. 11, but the operating rod 50 continues moving downwardly as a result of inertia until its downward movement is finally terminated shortly after generally stationary stop 92 engages stop 60 on the operating rod, as will soon be explained more fully. FIG. 11 depicts the parts immediately after stop 92 has engaged stop 60, but operating rod 50 is still undergoing downward overtravel.

Figure 9:
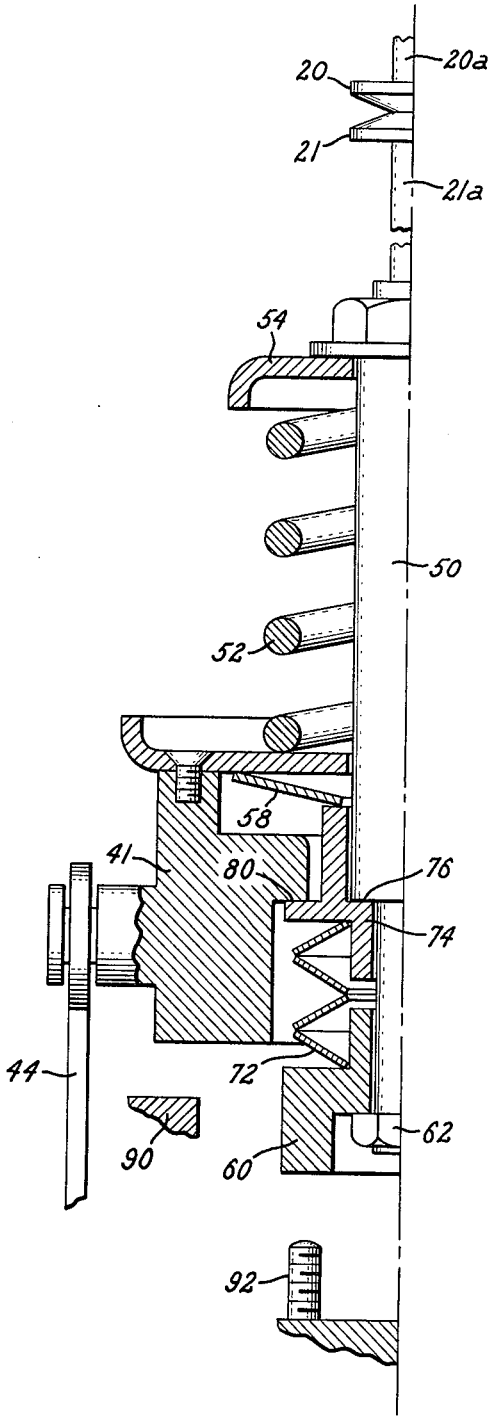
FIG. 9 shows the circuit breaker of FIG. 8 in a position through which it passes shortly after an opening operation has begun but before the contacts have parted.

Downward motion of the trunnion 41 from its position of FIG. 8 occurs with little opposition until the lower face 80 of the trunnion strikes the upper face of sleeve 74, as shown in FIG. 9. This partially compresses auxiliary spring 72 and temporarily separates sleeve 74 in a downward direction from shoulder 76 (which action is not specifically illustrated in the drawings). After this has occurred, continued downward opening motion of the trunnion is transmitted to the operating rod 50 through auxiliary spring 72, thus carrying the operating rod through an opening stroke in essentially the same manner as described with respect to FIGS. 6 and 7. Just prior to the downwardly-moving trunnion's reaching its above-referred-to position of FIG. 9, it encounters the disc spring 58 and thereafter essenatially flattens the disc spring before reaching its position of FIG. 9. The force transmitted through the disc spring 58 by this flattening action is relatively low in view of the relative weakness of the disc spring, and as a result downward motion of the operating rod does not substantially commence until the shoulder 80 on the trunnion encounters the sleeve 74.

Figure 10:
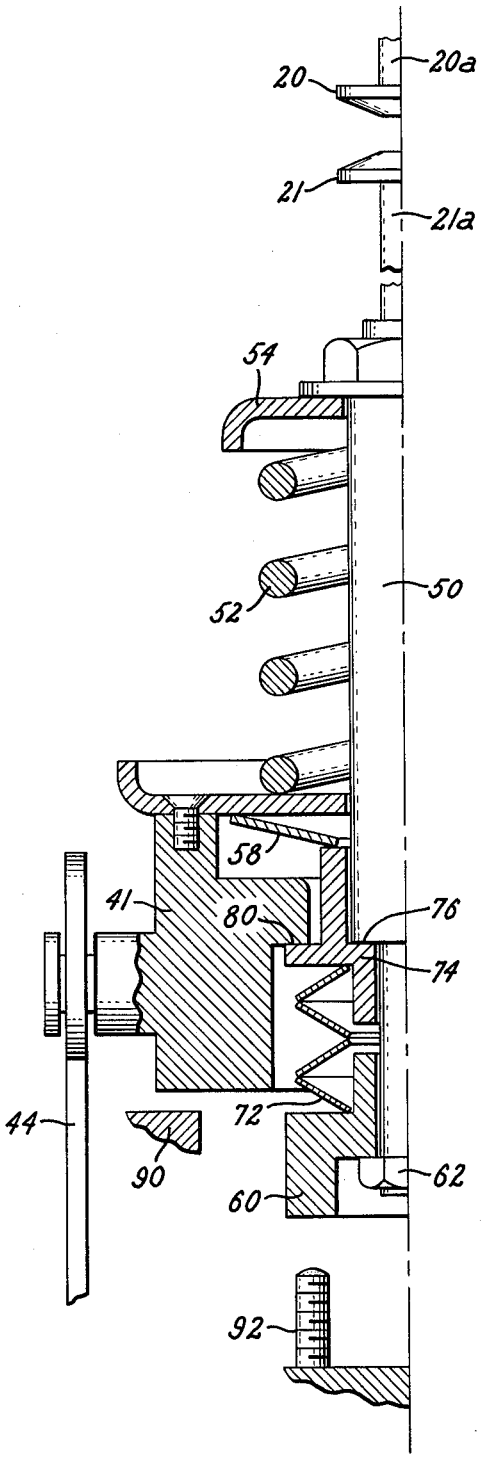
FIG. 10 shows the circuit breaker of FIG. 8 in a position through which it passes after a major portion of an opening operation has taken place.
Figure 11:
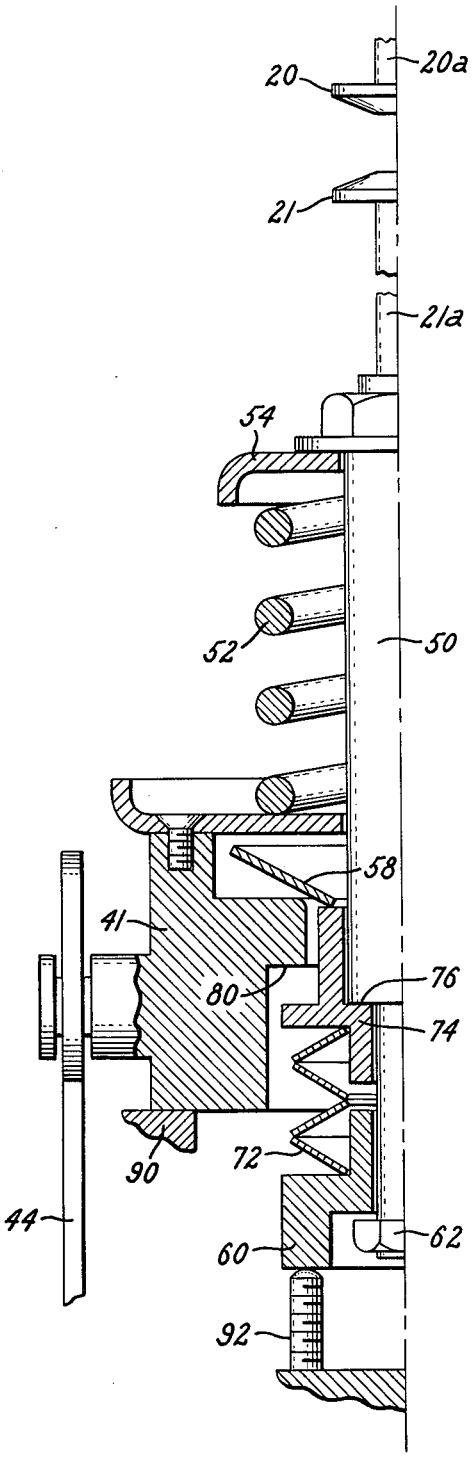
FIG. 11 shows the circuit breaker of FIG. 8 in a position through which it passes after the opening operation has advanced further and is near its completion. Contact rod 50 in FIG. 11 is undergoing limited overtravel immediately following impact between parts 60 and 92.

Downward motion of trunnion 41 from its position of FIG. 9 into its position of FIG. 10 carries operating rod 50 through most of its opening stroke, thereby carrying movable contact 21 through most of its opening stroke. When the downwardly-moving trunnion 41 finally engages stationary stop 90, its downward motion is terminated, but downward motion of operating rod 50 (against the opposition of wipe spring 52) continues through inertia until it is terminated by generally stationary overtravel stop 92. As shown in FIG. 11, this stop 92 engages the downwardly-moving stop 60 on the operating rod, causing the auxiliary spring 72 to be compressed between shoulder 76 and stop 60, thereby applying an additional effective decelerating force to the operating rod, as described in connection with FIGS. 6 and 7.

It is advantageous to dissipate the opening energy with multiple sequentially-acting stops, as has been described hereinabove. These stops arrest the opening motion in parts, causing relative motions which dissipate energy and also reduce shock loads on any part of the system.

Closing of the circuit breaker is effected by driving the trunnion 41 from its at-rest, fully-open position (which is approximately that shown in FIG. 10) upwardly back into its position of FIG. 8. The auxiliary spring 72 does not effectively enter into this closing operation since it is trapped between stop 60, 62 and shoulder 76 on the operating rod. When the upwardly-moving trunnion 41 enters its position to FIG. 9, during the closing operation the movable contact 21 engages stationary contact 20, and further upward motion of operating rod 50 and sleeve 74 is terminated. As a result, the disc spring 58 begins unloading, returning to its more conical shape, as the trunnion 41 continues moving upwardly toward its position of FIG. 8. This unloading of the disc spring reduces the rate of force build-up on the contacts during the brief period immediately following contact engagement, thus reducing the tendency of the contacts to bounce apart, all as explained in connection with FIGS. 1–5. The disc spring 58 of FIGS. 8–11 is selected to have a stiffness gradient k that bears essentially the same relationship to the stiffness gradient K of the operating linkage 40 as is present in the embodiment of FIGS. 1–5.

It will be apparent that the preload force on auxiliary spring 72 can be adjusted in the same manner as in FIGS. 6 and 7, i.e., by adjusting of the position of nut 62 on operating rod 50 when the circuit breaker is fully opened. This shifts the position of stop 60 on the operating rod to change the compression of auxiliary spring 72 but does not affect the disc spring 58 since sleeve 74 bears against the shoulder 76 on the operating rod.

It will be apparent from from the above description of FIGS. 8–11 that this wipe mechanism of FIGS. 8–11 prevents the contacts from bouncing apart immediately following closing engagement is essentially the same manner as the embodiment of FIGS. 1–5 and precisely controls the force on the movable contact at the start and termination of an opening operation in essentially the same manner as the embodiment of FIGS. 6 and 7.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. In a vacuum circuit beaker;

(a) a vacuum-type circuit interrupter comprising an evacuated housing, a generally stationary contact and a movable contact within said housing, a generally stationary conductive rod on which said stationary contact is mounted and a movable conductive contact rod on which said movable contact is mounted for motion into and out of engagement with said stationary contact, (b) an operating linkage for transmitting contact-closing and contact-opening forces to said movable contact rod, (c) a contact-wipe mechanism for coupling said linkage to said movable contact rod and comprising:

($c_1$) a driving part coupled to said linkage, ($c_2$) a driven part coupled to said movable contact rod, ($c_3$) a preloaded wipe spring between said driving and driven parts through which contact-closing force is transmitted from said linkage to said movable contact rod, said driving part continuing to move in a closing direction after said contacts initially engage at the end of a closing stroke, thereby further loading said wipe spring and thus causing said wipe spring to apply added force in a closing direction to said movable contact, (d) said contact-wipe mechanism further comprising a bounce-suppressing spring action in opposition to said wipe spring and discharging to aid said continuing motion of said driving part during the initial stages of said continuing motion following initial contact-engagement, (e) said bounce-suppressing spring having a stiffness gradient sufficiently low to effectively prevent separation of said contacts immediately following said initial contact-engagement at the end of a closing stroke, and (f) said operating linkage having a stiffness gradient that would permit said contact-separation immediately following said initial contact-engagement if said bounce-suppressing spring were absent.

2. A vacuum circuit breaker as defined in claim 1 in which said bounce-suppressing spring is effectively located between said movable contact rod and said driving part.

3. A vacuum circuit breaker as defined in claim 2 in which said bounce-suppressing spring is a disc-type spring.

4. A vacuum circuit breaker as defined in claim 1 which said contact-wipe mechanism further comprises force-transmitting means impacted by said driving part after a predetermined initial motion of said driving part in a contact-opening direction for transmitting contact-opening force from said driving part to said movable contact rod, said force-transmitting means comprising additional spring means that yields in response to said impact to limit the initial accelerating force applied to said movable contact rod, said additional spring means being loaded to a higher force level at the time of said opening impact than said bounce-suppressing spring.

5. The vacuum circuit breaker of claim 4 in combination with:

(a) stop means for abruptly terminating opening motion of said driving member at the end of an opening stroke, thus causing said movable contact rod thereafter to overrun said driving member against the opposition of said wipe spring, and (b) means acting through said additional spring means to apply a decelerating force to said movable contact rod during said overrunning travel of said contact rod at the end of an opening stroke.

6. The vaccum circuit breaker of claim 5 in which said means of (b), claim 5, comprises:

(a) an operating rod coupled to said contact rod, (b) spaced structures fixed to said operating rod, (c) two members slidable on said operating rod and biased in opposite directions by said auxiliary spring against said structures, respectively, and (d) a generally stationary stop impacting one of said slidable members during said overrunning travel at the end of an opening stroke to impart decelerating force to said operating rod through said auxiliary spring, the other of said slidable members, and one of said structures fixed to said operating rod.

7. The vacuum circuit breaker of claim 1 in which:

(a) N vacuum-type circuit interrupters are provided, each corresponding to the interrupter defined in (a) of claim 1, (b) means is provided for coupling the movable contact rod of each interrupter to said operating linkage through the interrupter's own contact-wipe mechanism corresponding to the contact-wipe mechanism defined in (*c*) and (*d*) of claim 1, and (c) the contact-bounce suppressing spring in each wipe mechanism has a stiffness gradient $k$ less than about K/0.22N, where K is the stiffness gradient of said operating linkage, and said operating linkage extends between said wipe mechanism and an operating device that applies closing force to the input end of said operating linkage.

8. The vacuum circuit breaker of claim 1 in which:

(a) three vacuum-type circuit interrupters are provided, each corresponding to the interrupter defined in (a) of claim 1, (b) means is provided for coupling the movable contact rod of each interrupter to said operating linkage through the interrupter's own contact-wipe mechanism corresponding to the contact-wipe mechanism defined in (c) and (d) of claim 1, and (c) the contact-bounce suppressing spring in each wipe mechanism has a stiffness gradient less than about 1.5 K, where K is the stiffness gradient of said operating linkage, and said operating linkage extends between said wipe mechanism and an operating device that applies closing force to the input end of said operating linkage.

9. The vacuum circuit breaker of claim 8 in which the contact-bounce suppressing spring in each wipe mechanism has a stiffness gradient approximately equal to the stiffness gradient of said operating linkage.

10. The vacuum circuit breaker of claim 1 in which:

(a) without said bounce-suppressing spring, contact engagement at the end of a closing stroke causes said movable contact rod to transiently reverse and briefly separate said movable contact from said stationary contact while closing force is being applied to said operating linkage.

(b) said bounce-suppressing spring has a stiffness gradient surfficiently low to prevent said reversal of the contact rod.

11. The vacuum circuit breaker of claim 1 in which said bounce-suppressing spring has a stiffness gradient sufficiently low to prevent contact-separating reversal of said movable contact rod immediately following contact-engagement and while a closing force is still being applied to said operating linkage.

12. A vacuum circuit breaker as defined in claim 1 and further comprising:

(a) a substantially rigid support for said interrupter, and (b) means for substantially rigidly coupling said stationary rod to said support so that impact forces developed when said movable contact strikes said stationary contact at the end of a closing operation are transmitted to said support via a path that effectively bypasses most of said housing.

13. The vacuum breaker of claim 12 in which said bounce-suppressing spring is effectively located between said movable contact rod and said driving part.

14. A vacuum circuit breaker as defined in claim 7 and further comprising means for substantially rigidly coupling the stationary contact of each interrupter to a substantially rigid support for said associated interrupter.

15. A vacuum circuit breaker as defined in claim 8 and further comprising means for substantially rigidly coupling the stationary contact of each interrupter to a substantially rigid support for said associated interrupter.

16. A vacuum circuit breaker as defined in claim 9 and further comprising means for substantially rigidly coupling the stationary contact of each interrupter to a substantially rigid support for said associated interrupter.

17. A vacuum circuit breaker as defined in claim 10 and further comprising means for substantially rigidly coupling the stationary contact of each interrupter to a substantially rigid support for said associated interrupter.

18. A vacuum circuit breaker as defined in claim 1 and further comprising means for mounting said generally stationary contact sufficiently rigidly so that without said bounce-suppressing spring the opposing forces exerted on said operating linkage upon contact-engagement at the end of a closing operation increase rapidly from zero to the wipe spring preload force in a time $t_1$ which is substantially shorter than $\frac{1}{4}$ of the natural period $T_2$ of vibration of said operating linkage, said operating linkage extending between said wipe mechanism and an operating device that applies closing force to the input end of said operating linkage.

19. A vacuum circuit breaker as defined in claim 7 and further comprising means for mounting the generally stationary contact of each interrupter sufficiently rigidly so that without said bounce-suppressing spring the opposing forces exerted on said operating linkage upon contact-engagement at the end of a closing operation increase rapidly from zero to the wipe spring preload force in a time $t_1$ which is substantially shorter than ¼ of the natural period $T_2$ of vibration of said operating linkage, said operating linkage extending between said wipe mechanism and an operating device that applies closing force to the input end of said operating linkage.

20. A vacuum circuit breaker as defined in claim 8 and further comprising means for mounting the generally stationary contact of each interrupter sufficiently rigidly so that without said bounce-suppressing spring the opposing forces exerted on said operating linkage upon contact-engagement at the end of a closing operation increase rapidly from zero to the wipe spring preload force in a time $t_1$ which is substantially shorter than ¼ of the natural period $T_2$ of vibration of said operating linkage, said operating linkage extending between said wipe mechanism and an operating device that applies closing force to the input end of said operating linkage.

21. In a vacuum circuit breaker:

(a) a vacuum-type circuit interrupter comprising an evacuated housing, a generally stationary contact and a movable contact within said housing, a generally stationary conductive rod on which said stationary contact is mounted and a movable conductive contact rod on which said movable contact is mounted for motion into and out of engagement with said stationary contact, (b) a support for said interrupter, (c) an operating linkage for transmitting contact-closing and contact-opening forces to said movable contact rod, (d) a contact-wipe mechanism for coupling said linkage to said movable contact rod and comprising:

($d_1$) a driving part coupled to said linkage, ($d_2$) a driven part coupled to said movable rod, ($d_3$) a preloaded wipe spring between said driving and driven parts through which contact-closing force is transmitted from said linkage to said movable rod, (e) said contact wipe mechanism further comprising force-transmitting means impacted by said driving part after a predetermined initial motion of said driving part in a contact-opening direction for transmitting contact-opening force from said driving part to said movable contact rod, said force-transmitting means comprising preloaded auxiliary spring means that yields in response to said impact to reduce the initial accelerating force applied to said movable contact rod, (f) and means acting near the end of an opening stroke to apply through said auxiliary spring means a decelerating force to said movable contact rod.

22. The circuit breaker of claim 21 in combination with adjustable means for preloading said auxiliary spring means with a force sufficiently low that said movable contact is not deformed by said initial accelerating force.

23. The circuit breaker of claim 21 in which:

(a) said wipe mechanism further comprises: an operating rod coupled to said movable contact rod and to said driven part, a sleeve carried by said operating rod and slidable thereon, and a stop carried by said operating rod and also slidable thereon, (b) said auxiliary spring comprises a compression spring located between said sleeve and said stop and biasing said sleeve and said stop against spaced structures fixed to said operating rod, (c) said driving part applies an impact force to said operating rod through said sleeve and said auxiliary spring to effect initial acceleration of said contact rod during an opening operation, (d) a generally stationary member is provided for engaging said stop near the end of an opening stroke to apply said decelerating force to said operating rod through said stop and said auxiliary spring.

24. The circuit breaker of claim 21 in which:

(a) said contact-wipe mechanism further comprises spaced structures fixed with respect to said contact rod and two members located between said spaced structures and movable with respect to said contact rod, (b) said auxiliary spring means comprises a compression spring located between said two members and biasing said members respectively toward said spaced structures, (c) said driving part applies an impact force through one of said members to said compression spring and then to said contact rod to effect initial acceleration of said contact rod during an opening operation, and (d) a stop is positioned to engage the other of said members near the end of an opening stroke to apply said decelerating force through said other member to said compression spring and then to said contact rod.

* * * * *